US006021910A

United States Patent [19]

Franklin

[11] Patent Number: 6,021,910

[45] Date of Patent: Feb. 8, 2000

[54] CONSTRUCTION CRANE BASE

[76] Inventor: James W. Franklin, 1611 Francisca Rd. NW., Albuquerque, N.Mex. 87107

[21] Appl. No.: 08/948,603

[22] Filed: Oct. 10, 1997

Related U.S. Application Data

[63] Continuation of application No. 08/661,811, Jun. 11, 1996, abandoned, which is a continuation of application No. 08/392,136, Feb. 22, 1995, abandoned, which is a division of application No. 08/086,007, Jul. 1, 1993, Pat. No. 5,426,907.

[51] Int. Cl.[7] ..... B66C 23/28

[52] U.S. Cl. ..... 212/270; 212/175; 212/176; 212/204

[58] Field of Search ..... 212/270, 175, 212/176, 179, 199, 200, 201, 202, 203, 204; 414/10; 187/239, 900; 182/82, 146, 147, 148, 149, 150

[56] References Cited

U.S. PATENT DOCUMENTS

| | | | |
|---|---|---|---|
| 673,384 | 5/1901 | Clark . | |
| 785,289 | 3/1905 | Campbell . | |
| 1,175,049 | 3/1916 | Cull | 212/202 |
| 2,432,528 | 12/1947 | Lively | 212/202 |
| 2,720,694 | 10/1955 | Hines | 212/176 |
| 3,053,398 | 9/1962 | Liebherr et al. | 212/176 |
| 3,127,996 | 4/1964 | Schwing | 212/176 |
| 3,153,486 | 10/1964 | Strnad | 212/176 X |
| 3,302,749 | 2/1967 | Heaphy et al. | 182/82 |
| 3,333,712 | 8/1967 | Owen | 212/176 |
| 3,366,251 | 1/1968 | Strnad | 212/176 |
| 3,776,498 | 12/1973 | Peters et al. | 248/221 |
| 3,777,900 | 12/1973 | Brewer | 212/200 |
| 3,923,163 | 12/1975 | Brewer | 212/175 |
| 3,998,029 | 12/1976 | James et al. | 212/176 |
| 4,002,222 | 1/1977 | Bruno | 182/183 |
| 4,452,336 | 6/1984 | Stickler | 182/82 |
| 4,496,277 | 1/1985 | Jungman | 212/202 |
| 4,732,234 | 3/1988 | Brickman | 182/183 |
| 4,856,662 | 8/1989 | Marvin et al. | 212/175 X |
| 4,909,350 | 3/1990 | Jacobs | 182/82 |
| 4,953,720 | 9/1990 | Okano et al. | 212/176 |

FOREIGN PATENT DOCUMENTS

| | | | |
|---|---|---|---|
| 711646 | 6/1965 | Canada | 182/14 |
| 3-3893 | 1/1991 | Japan | 212/175 |
| 195694 | 8/1991 | Japan | 212/179 |
| 4191295 | 7/1992 | Japan | 212/176 |
| 1461749 | 2/1989 | Russian Federation | 212/179 |
| 1276612 | 12/1986 | U.S.S.R. | 212/179 |

*Primary Examiner*—Thomas J. Brahan
*Attorney, Agent, or Firm*—John R. Lansdowne

[57] ABSTRACT

A platform assembly designed for use in supporting a crane during the construction of a multi-story building is described. The assembly includes a platform for supporting a crane and means for fixedly attaching the platform to differing locations along the length of a structural column of such building during construction of the latter.

19 Claims, 4 Drawing Sheets

CONSTRUCTION CRANE BASE

This application is a continuation application of application Ser. No. 08/661,811, filed on Jun. 11, 1996, now abandoned, which is a continuation application of Ser. No. 08/392,136, filed on Feb. 22, 1995, now abandoned, which is a divisional application of Ser. No. 08/086,007 filed on Jul. 1, 1993, now U.S. Pat. No. 5,426,907.

BACKGROUND OF THE INVENTION

The present invention relates to multi-story building construction and, more particularly, to a method of using a crane arrangement to facilitate such construction.

In the construction of multi-story (high rise) buildings it is common to have one or more temporary crane arrangements for hoisting material and other loads to various elevations for such construction. These cranes often have long horizontal booms to provide access to much of the area of the building. Such temporary cranes typically are dismantled and removed when there is no longer a construction need for the same.

SUMMARY OF THE INVENTION

The present invention eliminates the need for temporary cranes of the type heretofore used. In its basic aspects, the invention is a construction method utilizing a crane platform assembly which includes both a platform for a crane and means for fixedly cantilevering the platform from a column of the structural frame of the building at differing, generally vertical locations. In this connection, it is typical to construct a building with a multiplicity of vertical structural frame columns. Such columns are the first component parts of a building structural frame to be erected. In concrete building construction, these vertical columns are often concrete filled structural frame column sections. (It should be noted that it is becoming increasingly common to construct composite columns for concrete buildings, columns which include a metal tube or the like filled with high strength concrete.) The remainder of the structural frame for the building then becomes the concrete slabs which are provided separating each level, such slabs acting as diaphragms connecting the multiple columns and the building core together. The structural frame contribution of these slabs is quite important. In this connection, slabs of this nature are often referred to as "ductile" slabs in building constructions designed to resist earthquakes, and they are connected with the frame members in a manner to prevent the structural frame rigidity associated with earthquake damage. In steel structures, structural vertical columns are part of a structural steel frame for the building.

With the invention a vertical structural frame column of either a concrete or steel building provides two functions—it not only acts as part of the building structure as is common, but during the construction of the building acts to support a crane. The attaching means or in other words the cantilevering means for the crane platform most desirably includes a collar configured to circumscribe a vertical structural column at the differing heights, preferably adjacent structural bracing for the column. (In this connection, it must be remembered that the slabs themselves are structural bracing.) A hoist arrangement also is included for moving the crane platform assembly vertically between the differing locations at which it is to be attached to the column. The structural column also desirably is a corner column for the building. The use of a corner column provides certain advantages which will become apparent from the more detailed description.

The crane is able to rotate on the platform as may be desired to hoist or place material at particular locations. Also, most desirably a pivot is provided in the platform to enable the platform to be rotated in a generally horizontal plane relative to the vertical structural column.

The invention also includes a construction method in which a crane is secured at different locations vertically along the length of a structural column. In this connection, use of the crane platform assembly of the invention enables much faster and less expensive construction.

Other features and advantages of the invention either will become apparent or will be described in connection with the following, more detailed description of preferred embodiments of the invention.

BRIEF DESCRIPTION OF THE DRAWING

With reference to the accompanying drawing.

DETAILED DESCRIPTION OF THE PREFERRED EMBODIMENT(S)

Figure 1:
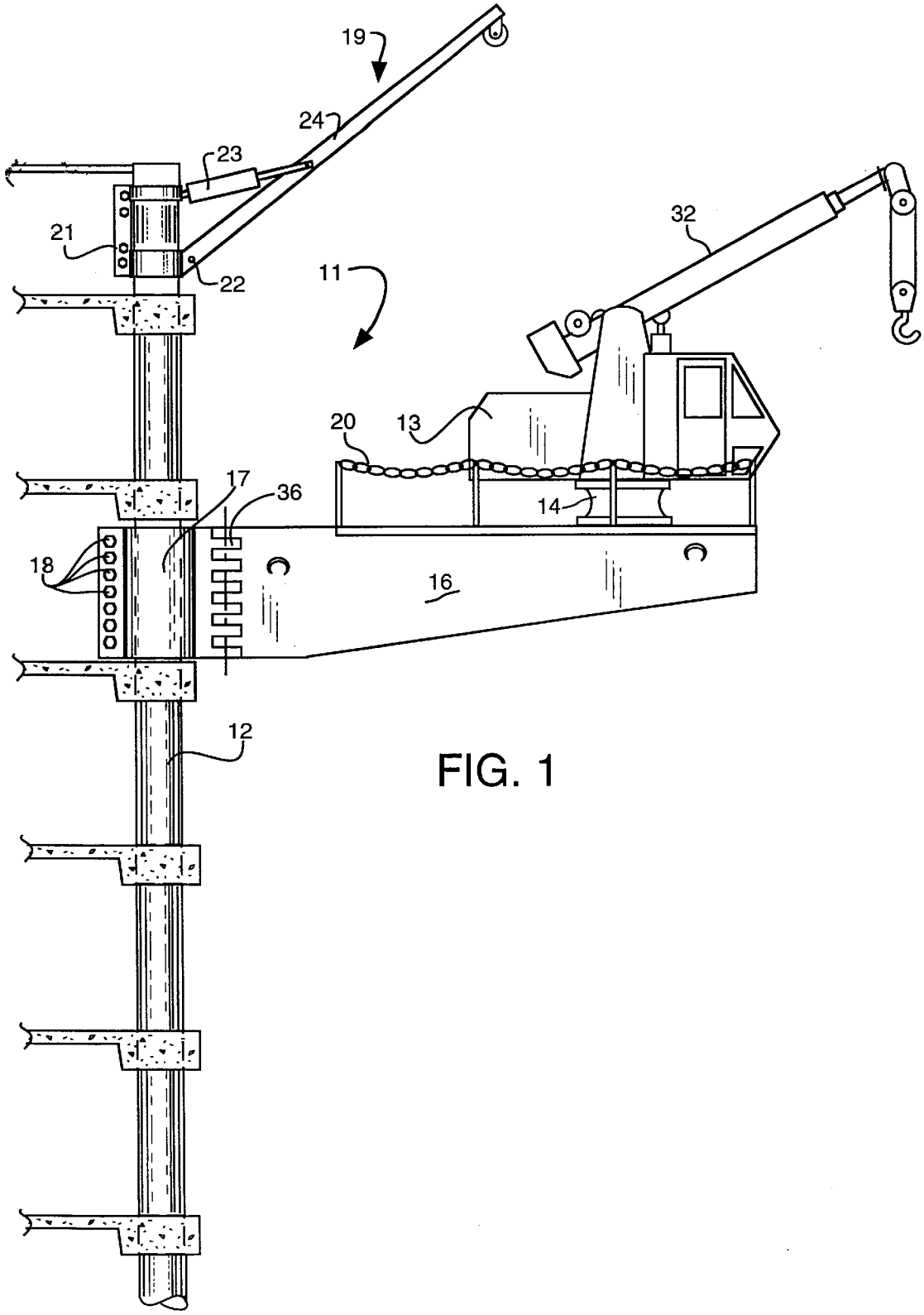
FIG. 1 is a schematic side view illustrating a preferred embodiment a crane platform assembly utilized in the method of the invention, and its relationship to a building under construction.

The following relatively detailed description is provided to satisfy the patent statutes. However, it will be appreciated by those skilled in the art that various changes and modifications can be made without departing from the invention.

A preferred embodiment of the platform assembly used in the method of the invention is generally referred to by the reference 11. Such assembly 11 is cantilevered from a vertical single structural column 12 of a building under construction. Column 12 is preferably a column located at a corner of two sides of the building under construction. It supports a crane represented at 13 via a standard crane base 14 which enables rotation of the crane. The crane 13 simply can be a pedestal mounted crane, such as a hydrocrane often used in construction projects for other purposes.

In keeping with the invention, the crane platform assembly is cantilevered from and, hence, so is the crane through the intermediary of the assembly, differing locations along the length of the structural column. The assembly includes both a platform 16 which provides the actual support for the crane and a latching collar 17 which can secure the platform to the structural column both fixedly and non-movably. Latching collar 17 is a three-piece friction collar having two clam shell sections which can be opened and closed so that the collar will alternately release and circumscribe a column as desired at a selected location. All the sections of such collar are lined with rubber so as to provide a friction securance. In the schematic showing in the drawing, a plurality of bolts 18 are illustrated holding the clam shell sections of the collar together surrounding the column in the selected location. In this connection, it is to be noted that the collar terminates at each end adjacent a floor/ceiling slab which provides structural bracing for the vertical column.

The weight supported by the collar is high. (In one implementation the base itself weighed about 11,000 lbs. and the crane added to it about 20,000 lbs. This is in addition to any weight supported by the crane.) Moreover, such weight is cantilevered from the structural column. This grasping of the column by the collar adjacent the structural bracing provided by the slabs enhances the ability of the column to support the crane, etc. A safety chain arrangement, schematically represented at 20, is included for the safety of personnel. Although details are not shown, the arrangement 20 is one which can be pivoted to be out of the way except when personnel need protection. Of course, other safety arrangement can be provided as desired or to comply with local regulations.

It is desirable in many situations to include a pivot as part of the assembly. Such a pivot is represented at 36. To withstand the significant mechanical forces to which it may be subjected, this pivot can have a series of tapered roller thrust bearings. The decision to include such a pivot in a particular arrangement, will depend, of course, upon many factors, including the desired rotation versatility.

Figure 2:
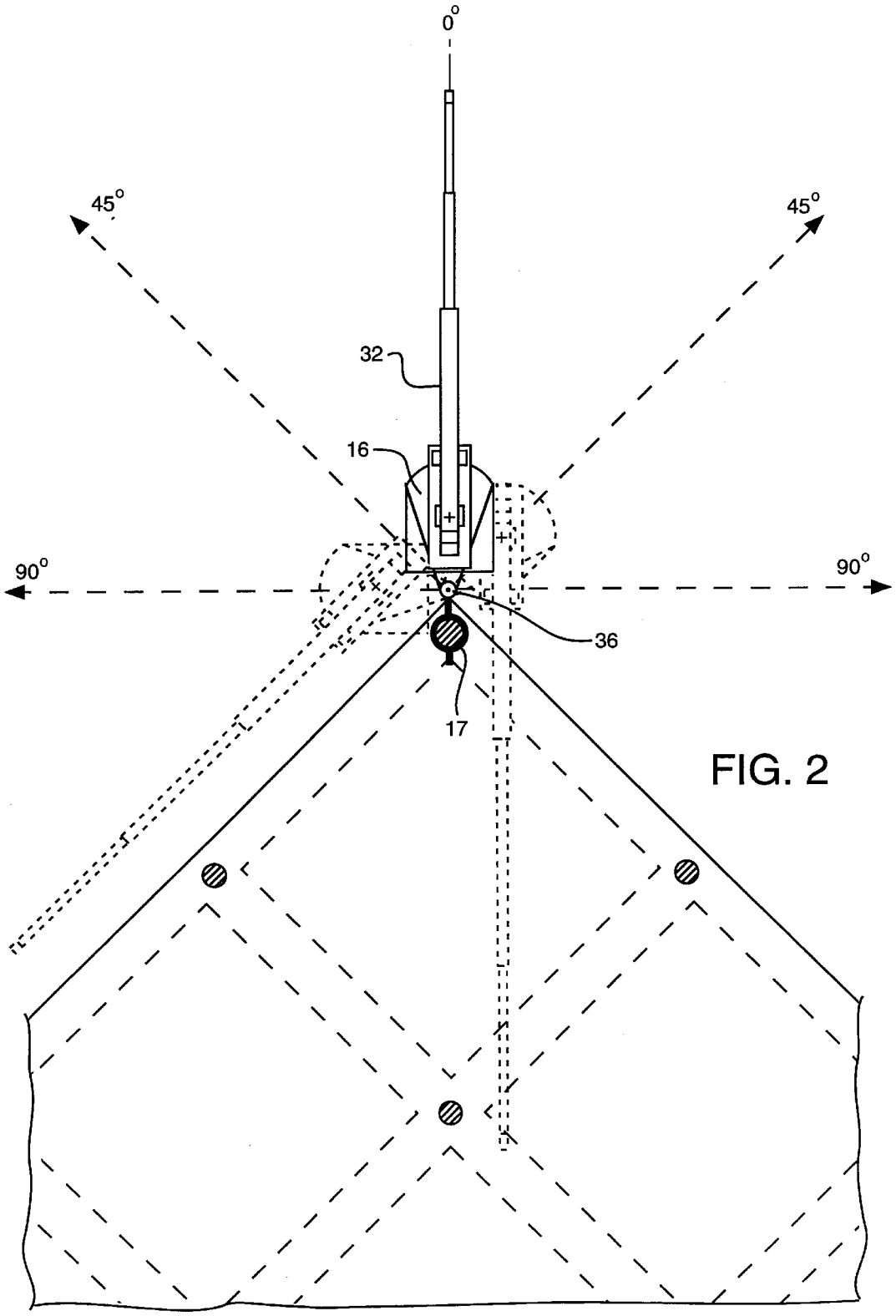
FIG. 2 is a schematic top elevation view illustrating differing positions of a crane and of the platform assembly when it includes a pivot.

FIG. 2 illustrates the operational capability of a crane and crane platform assembly. It is a plan view showing the assembly in solid attached to a corner structural column of a building. At such location the crane has access to any floor along two exterior walls, for example to facilitate installation of windows and exterior curtain walls between slabs. The crane also is usable to provide access interiorly of the surface area at the job site to be covered by the building. It will be appreciated that with a luffing jib (not shown in FIGS. 1–3 for simplicity) on the end of the crane boom access between already installed floor slabs also is possible. This interior access is important because it eliminates the need for landing platforms as commonly used.

It should be noted that in FIG. 2 there are two potential motions which are added together to provide the illustrated movement. One is a slewing of the platform itself about pivot 36 and the other is rotation of the crane on the platform. Although only a few different positions of the platform relative to the attaching means are illustrated, it will be appreciated that relatively unlimited positions can be provided. An operator can move between said positions simply by slewing the platform between the same. It will be recognized that when a pivot 36 is not included, the movement will be somewhat limited because it is only crane rotation on the platform which is available.

Figure 3:
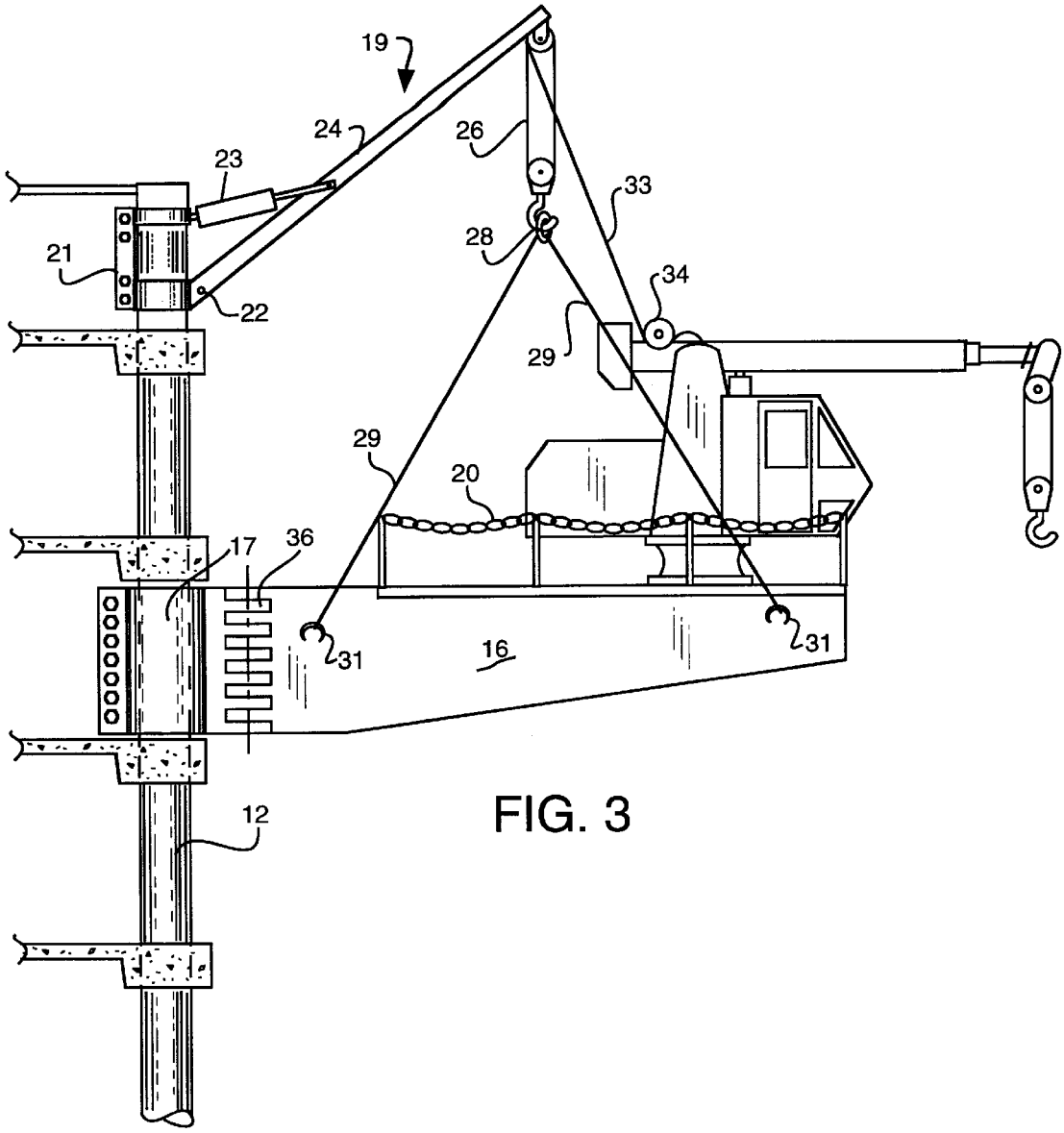
FIG. 3 is a schematic view similar to FIG. 1 illustrating rigging associated with hoisting or lowering the crane and crane platform assembly of FIG. 1.

FIG. 3 illustrates the rigging for moving the platform assembly vertically between differing locations. In this connection a lowering jib, represented at 19, acts to raise and lower the platform. Such jib is secured via a collar 21 to the upper end of the column 12 as is illustrated. That is, it is pivotally secured to the collar at 22, and a solenoid connection 23 is connected between the collar upper end and the jib boom 24 for changing the angular relationship of the latter as appropriate. A pulley set or block 26, akin to a block and tackle arrangement, is connected between the upper end of the boom and a suspension ring 28. The suspension ring, in turn, supports two cables, one of which is shown at 29, connected to the platform 16, on opposite sides thereof at suspension points, two on one side being shown and represented at 31. It will be seen that the location of the suspension ring 28 along the cables can be adjusted as necessary for balance. Moreover, when the crane base is suspended, the crane boom 32 can be extended or retracted for balance as desired.

The winch motor of the crane itself is used to power the block 26. In this connection, the line which operates the crane extends, as represented at 33, from the normal crane winch motor cable drum 34 to the upper sheave arrangement. In one specific design, the block 26 included seven lines, one of which is the line 33 extended to the cable drum 34.

Vertical movement of the crane between the differing locations on the structural column is a relatively simple procedure. The rigging for suspending the assembly needs to be installed, and the friction collar released at the first position. Actuation and control of the jib, the winch and the position of the boom is effected by remote control, e.g., an operator on a floor slab of the building can move the assembly between the floor level of the "old" location and the "new" location. The friction collar is then reattached to the column at the new location. It is to be noted that there are only three different functions for raising and lowering the assembly, control of the winch, control of the jib solenoid, and control of the position of the boom.

Figure 4:
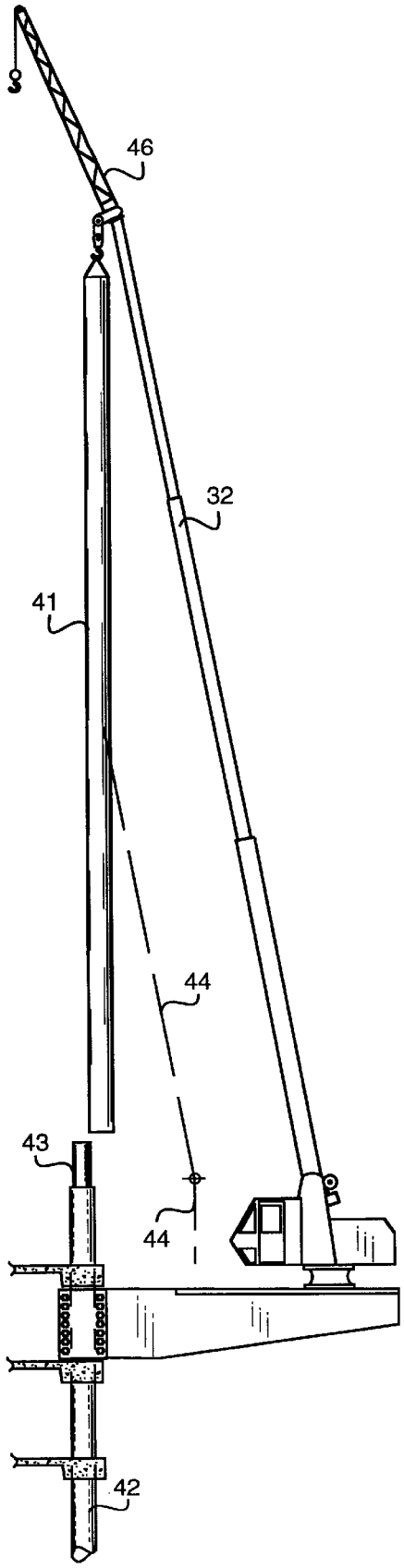
FIG. 4 is another schematic illustration showing how the crane platform assembly can be used to add a section on the very same structural column which supports the same.

The assembly permits a crane to be used to erect its own vertical support. In other words, when a platform assembly used in the invention is at the highest location between levels provided by one section of column, such platform assembly can be used to install the next higher section which then will provide the differing locations at which it is attached. In this connection, FIG. 4 illustrates a crane on the crane base of the invention installing a section 41 of a vertical structural column on a section 42 of the same already in place. While there are numerous ways in which two sections of a structural column can be rigidly attached together at their joint, one way is illustrated in FIG. 4 as part of the preferred embodiment shown. That is, the upper end of section 42 is relieved as indicated at 43 to accept a complementary cavity (not shown) at the lower end of the section 41 to be installed. The exposed joint between the sections can be welded, and concrete inserted within the section 41 to complete the portion of the vertical column it represents. Nelson studs and/or rebar is preferably provided to interact with the concrete to aid in forming a rigid joint. Once the section 41 is connected to the section 42, the structural frame platform can be moved to differing locations on the section 41 as structural bracing is provided.

It should be noted that the length of the section 41 is dependent upon the distance of the crane from the vertical column or, in other words, the length of the platform 16. If the platform is shorter than that shown, the beam section which can be raised is correspondingly shorter. To aid in illustrating the point, broken lines 44 are included to show the boom limitations relative to the center line of the column. It should be noted that the length of column section which can be suspended by the crane varies depending upon the suspension point. In the illustrated arrangement, the suspension point is at the top of the column section. As is known, though, vertical suspension can be obtained even when the suspension point is significantly lower along the length of the section. In one implementation of the invention, the platform was made sufficiently long to provide 20 ft. between the column and the center of rotation of the crane. This allowed approximately an 80 ft. section of column to be suspended from its top and added to a lower column section. The line 44 represents a crane-column spacing of only 10 ft. which will enable about a 40 ft. section of column to be suspended from its top and placed on top of a section already installed. It also should be noted that while as illustrated the platform assembly of FIG. 4 does not include a pivot, a pivot as described can be provided if desired.

As mentioned previously, the inclusion of a luffing jib on the end of the crane boom facilitates use of the crane to provide crane operations between levels for which the slabs have already been constructed. While for simplicity's sake such a luffing jib is not illustrated in connection with the earlier figures, such a luffing jib is shown in FIG. 4 at 46. It will be recognized that a luffing jib can be useful in many situations and the showing of the same only relative to FIG. 4, does not mean its use is limited to the remainder of the arrangement of FIG. 4. As mentioned previously, the use of such a luffing jib with the assembly of the invention enables one to obtain crane access between floor slabs and thereby eliminate the exterior landing platforms which are often provided.

As stated at the beginning of the detailed description, applicant is not limited to the specific embodiments described. Various changes and modifications can be made. The specific embodiments are exemplary, rather than exhaustive. The claims, their equivalents and their equivalent language define the scope of protection.

What is claimed is:

1. In a method of constructing a multi-story building, the steps of:

(A) cantilevering a platform assembly comprising a platform for a crane from a first location selected from a group of differing locations along the length of a single structural column located at a corner along two sides of said building, said step of cantilevering including securing said platform assembly to said column at said first location;

(B) pivoting the platform of said assembly about a vertical axis along two sides of said building while such platform is at said first location to from one side of the building to another side of the building; and thereafter (C) cantilevering said platform assembly from a second location selected from said group of locations, said step of cantilevering including securing said platform assembly to said column at said second location.

2. The method of claim 1, the further steps of hoisting said crane with a jib along the length of said structural column between said differing locations.

3. The method of claim 1 further including pivoting said platform while it is at said second location to at least one differing generally horizontal position relative to said structural column.

4. In a method of constructing a multi-story building, the steps of:

(A) cantilevering a crane from a first location along the length of a single generally vertical structural column located at the corner along two sides of said building, said column at said first location and said location being selected to be adjacent structural bracing for said column;

(B) pivoting the platform of said assembly about a vertical axis along two sides of said building while such platform is at said first location to from one side of the building to another side of the building; and thereafter (C) hoisting said crane along the length of said column to a second location selected to be adjacent structural bracing for said column; and (D) cantilevering said crane from said second location, said cantilevering including securing said crane to said column at said second location.

5. The method of claim 4 wherein each of the steps of cantilevering a crane from a structural column includes securing a platform assembly for said crane to said structural column.

6. The method of claim 4 wherein said multi-story building is a concrete frame building and each of said steps of cantilevering includes selecting the location for the same along said column to be adjacent a generally horizontal ductile diaphragm concrete slab which operates as a horizontal component of said frame.

7. In a method of constructing a multi-story building, the steps of:

(A) cantilevering a crane from a first location along a first section of a single generally vertical structural column located at the corner along two sides of said building;

(B) pivoting the platform of said assembly about a vertical axis along two sides of said building while such platform is at said first location to from one side of the building to another side of the building; and thereafter (C) using said crane while it is cantilevered from said first section to hoist a second section of said column into place; and thereafter (D) cantilevering said crane from a second location that is along said second section of said generally vertical structural column for said building.

8. The method of claim 7 wherein each of said steps of cantilevering includes securing to said structural column a platform assembly having a platform for said crane.

9. The method of claim 7 wherein each of said steps of cantilevering includes selecting said location to be adjacent structural bracing for said generally vertical, structural column.

10. The method of claim 9 wherein said multi-story building is a concrete frame building and each of said steps of cantilevering includes selecting a location for the same along said column which is adjacent a generally horizontal ductile diaphragm concrete slab which operates as a horizontal component of said frame.

11. In a method of constructing a multi-story building, the steps of:

(A) cantilevering a crane having a winch from a first location along the length of a single generally vertical structural column located at a corner along two sides of said building, said cantilevering including securing said crane to said column;

(B) pivoting the platform of said assembly about a vertical axis along two sides of said building while such platform is at said first location to from one side of the building to another side of the building; and thereafter (C) providing a hoist having a boom above but generally free of said crane;

(D) using said hoist to support said crane;

(E) separating said crane from said column;

(F) using said hoist to move said crane to a second location along the length of said column; and (G) cantilevering said crane from said second location, said cantilevering including securing said crane to said column.

12. The method of claim 11 wherein each of the steps of cantilevering a crane from a structural column includes securing to said structural column a platform assembly having a platform for said crane.

13. The method of claim 11 wherein said steps of using said hoist include using the winch from said crane to provide hoisting along the length of said column.

14. The method of claim 11 wherein each of said steps includes selecting said location to be adjacent structural bracing for said generally vertical, structural column.

15. The method of claim 14 wherein said multi-story building is a concrete frame one, and each of said steps of cantilevering includes selecting the location for the platform assembly along said column to be adjacent a generally horizontal ductile diaphragm concrete slab which operates as a horizontal component of said frame.

16. In a method of constructing a multi-story concrete building, the steps of:

(A) cantilevering a platform assembly having a platform for a crane from a first location selected from a group of differing locations along the length of a single generally vertical structural column located at a corner along two sides of said building and which is adjacent a generally horizontal ductile diaphragm concrete slab which operates as a horizontal component of said frame;

(B) pivoting the platform of said assembly about a vertical axis along two sides of said building while such platform is at said first location to from one side of the building to another side of the building; and thereafter (C) cantilevering said platform assembly from a second location which is selected from said group of locations and also is adjacent a generally horizontal ductile diaphragm concrete slab which operates as a horizontal component of said frame; and (D) wherein each of said steps of cantilevering includes securing said platform assembly to said structural column.

17. The method of claim 16 further including the step of pivoting said platform while it is at said first location to at least one differing generally horizontal position relative to said structural column.

18. The method of claim 16 further including the step of moving said platform assembly between said first and second locations, said step including:

(i) providing a hoist having a boom above but generally free of said platform assembly;

(ii) using said hoist and its boom to support said platform assembly;

(iii) separating said platform assembly from said column; and (iv) using said hoist and its boom to move said platform assembly while said crane is on the platform thereof between said locations.

19. The method of claim 18 wherein said first location is provided along a first section of said column and said second location is provided along a second section of said column, and further using said crane while it is cantilevered from said first section to hoist said second section.

* * * * *